US006553600B2

(12) United States Patent
Fischer

(10) Patent No.: US 6,553,600 B2
(45) Date of Patent: Apr. 29, 2003

(54) MOBILE SWEEPING MACHINE

(75) Inventor: Franz Fischer, Leutenbach (DE)

(73) Assignee: Alfred Kaercher GmbH & Co., Winnenden (DE)

( * ) Notice: Subject to any disclaimer, the term of this patent is extended or adjusted under 35 U.S.C. 154(b) by 0 days.

(21) Appl. No.: 10/058,985

(22) Filed: Jan. 28, 2002

(65) Prior Publication Data

US 2002/0100130 A1 Aug. 1, 2002

Related U.S. Application Data

(63) Continuation of application No. PCT/EP00/06781, filed on Jul. 15, 2000.

(30) Foreign Application Priority Data

Aug. 7, 1999 (DE) ..... 299 13 845

(51) Int. Cl.[7] ..... A46B 13/02; A47L 11/22
(52) U.S. Cl. ..... 15/41.1; 15/52.1; 15/83
(58) Field of Search ..... 15/41.1, 52.1, 15/83

(56) References Cited

U.S. PATENT DOCUMENTS

| | | | | | |
|---|---|---|---|---|---|
| 984,336 | A | * | 2/1911 | Woodbury | 15/41.1 |
| 1,972,870 | A | | 9/1934 | Christesen | 15/41.1 |
| 2,178,917 | A | | 11/1939 | Pullen | 15/41.1 |
| 2,206,429 | A | * | 7/1940 | Redfearn | 15/41.1 |
| 2,235,432 | A | * | 3/1941 | Kenyon | 15/41.1 |
| 2,502,403 | A | * | 3/1950 | Kircher | 15/41.1 |
| 2,670,485 | A | | 3/1954 | Gomez | 15/52.1 |
| 3,196,473 | A | * | 7/1965 | Bell | 15/52.1 X |
| 4,155,610 | A | | 5/1979 | Englund | 312/222 |
| 4,263,689 | A | * | 4/1981 | Leibscher et al. | 15/41.1 |
| 4,484,371 | A | * | 11/1984 | Patzold et al. | 15/41.1 |
| 4,709,436 | A | * | 12/1987 | Berfield et al. | 15/41.1 X |
| 5,224,232 | A | * | 7/1993 | Kahuranec et al. | 15/41.1 |

FOREIGN PATENT DOCUMENTS

| | | | | |
|---|---|---|---|---|
| GB | 2134777 | * | 8/1984 | 15/41.1 |
| GB | 2252036 | * | 7/1992 | 15/41.1 |
| JP | 03-122309 | | 5/1991 | |

OTHER PUBLICATIONS

*Patent Abstracts of Japan*, Abstract of Japanese Patent No. 03122309, "Power Travelling Sweeper", vol. 015, No. 325, Aug. 19, 1991.

* cited by examiner

*Primary Examiner*—Mark Spisich
(74) *Attorney, Agent, or Firm*—Barry R. Lipsitz

(57) ABSTRACT

In order to facilitate emptying of the dirt collection container in a mobile sweeping machine with a rotationally driven rotary brush which is mounted in a housing, a dirt collection container which can be detachably connected to the housing and with a dirt inlet opening located adjacent to the rotary brush in the dirt collection container, it is proposed that the dirt collection container is configured as a drawer, which can be laterally inserted into a guide of the housing and can be fixed in its inserted position relative to the housing.

21 Claims, 5 Drawing Sheets

MOBILE SWEEPING MACHINE

The present invention is a continuation of international application PCT/EP 00/06781 of Jul. 15, 2000, the entire specification of which is incorporated herein by reference.

BACKGROUND OF THE INVENTION

The invention relates to a mobile sweeping machine with a rotationally driven rotary brush which is mounted in a housing, a dirt collection container which can be detachably connected to the housing and with a dirt inlet opening located adjacent to the rotary brush in the dirt collection container.

Sweeping machines of this type are known which can be moved manually by means of a shaft-type gripping element, for example, along a surface to be cleaned. In order to empty the dirt collection container filled with collected dirt particles, the housing can be snapped down so that emptying can be achieved through the then exposed opening of the dirt collection container. This requires a relatively complicated construction, which also makes handling difficult during emptying, since the entire sweeping machine must be transported to the emptying location.

It is the object of the invention to configure a sweeping machine of this type so as to facilitate emptying of the dirt collection container.

SUMMARY OF THE INVENTION

This object is achieved according to the invention with a mobile sweeping machine of the above-described type in that the dirt collection container is configured as a drawer, which can be laterally inserted into a guide of the housing and can be fixed in its inserted position relative to the housing. This drawer can be simply pulled laterally out of the housing for emptying and then carried to the emptying location, and by simply inserting and fixing it to the housing, the sweeping machine is ready for operation again.

It is advantageous if rollers, which fully support the sweeping machine, are disposed on the housing and on the dirt collection container, so that the sweeping machine is configured, on the one hand, by the housing and by the drawer, on the other.

In a preferred embodiment it is provided that the guide is disposed on a flat support part of the housing, which, running essentially parallel to the transport surface, extends from the working part of the housing accommodating the rotary brush and its drive.

In particular, the support part can essentially completely cover the drawer on its upper side.

It is advantageous if the guide is formed by strip-type projections extending into a groove.

In a particularly preferred embodiment it is provided that the groove and the strip-type projections are semicircular, this is particularly advantageous when the drawer and possibly the support part covering it are also correspondingly semicircular in order to obtain a pleasing form for the sweeping machine and also to ensure that even locations which are difficult to access can be well cleaned with this sweeping machine.

In particular with semicircular guides it is difficult to join the guide elements reliably, since these only engage shortly before the insertion process has ended.

In order to assist in this, it is particularly advantageous if a projection pointing in the direction of the housing is disposed on the drawer, said projection extending into a guide of the housing and thus guiding the drawer during insertion before the ledge-type projections enter the groove. As a result, the advantage to the user is that he does not need to take particular care to ensure that the strip-type guide elements also extend into the grooves during the insertion movement of the drawer.

It is particularly advantageous if the projection is formed by a half shell, which extends in the direction of insertion of the drawer and is inserted into a trough-shaped depression on the upper side of the housing. Such a half shell can have the form of a half pipe connection and extend into a correspondingly shaped trough-shaped depression.

In this case, the trough-shaped depression can have guide faces engaging over the upper edge of the half shell so that in the trough-shaped depression the half shell is also secured against swivelling around the longitudinal axis of the trough-shaped depression.

It is particularly advantageous in this case if the upper edge of the half shell has a section rising from the base of the half shell and a section adjoining this running parallel to the direction of insertion of the drawer. During insertion of the half shell into the trough-shaped depression the drawer is then automatically centred with respect to the housing, in particular the drawer is also rotated around a longitudinal axis running parallel to the direction of insertion into the position in which the strip-type projections can engage into the groove.

It can be provided in particular that the half shell is open on the front side at its end remote from the housing, the half shell thus forming a grip opening into which the user can grasp in order to operate the drawer.

It is advantageous if the trough-shaped depression merges into a receiving depression for a gripping element so that the trough-shaped depression assumes a further function, i.e. that of a receiving area for a gripping element, e.g. for the base of a shaft with which the sweeping machine can be moved.

In this case, it can be provided that a gripping element is disposed to swivel on the upper side of the housing and in an end position extends into the receiving depression and into the adjoining trough-shaped depression as well as the half shell inserted therein. The base portion of a rod-type gripping element, for example, can thus be accommodated on the upper side of the sweeping machine to save space when the sweeping machine is not in operation and must be stowed.

It is provided in a preferred embodiment that an elastic catch is provided to fix the drawer on the housing.

The elastic catch can preferably be disposed on the base of the half shell and engages behind a recess on the trough-shaped depression.

In a particularly preferred embodiment it is provided in that case that the elastic catch is formed by a region of the base of the half shell, which is separated from the rest of the half shell by two U-shaped incisions and only remains connected to the base of the half shell via two deformable webs located between the ends of the opposing incisions. Such an elastic catch is very simple to mould out of the base of the half shell by provision of the two U-shaped incisions, the narrow remaining webs are deformable in accordance with the selected material of the half shell, e.g. an elastic plastic material, to such an extent that the remaining base section may be swivelled slightly in relation to the rest of the base of the half shell.

It is beneficial in this case if at a distance below the half shell the trough-shaped depression forms a stop restricting the swivelling movement of the elastic catch, thus ensuring that the elastic catch is not deformed too much during the opening movement and damaged as a result.

In addition, it can be provided that spring elements are disposed between the housing and drawer which act on the drawer in its pull-out direction. As a result, upon release of the elastic catch, the drawer is necessarily pushed out of the locking position so that further locking is only possible when the drawer is intentionally pushed into the housing. This ensures that a brief application of pressure on the elastic catch is sufficient during release of the drawer and that then the drawer remains unlocked and can be pulled out of the housing without problem.

It is beneficial in this case if the spring elements are at the same time intermeshing guide elements.

In a preferred embodiment, moreover, it can be provided that the drawer has a grip depression on its underside opposite the half shell. As a result of this, the drawer is provided in the same manner with a depression on the upper side and on the underside so that the user can grip and operate the drawer using these two depressions in a particularly advantageous manner.

The following description of preferred embodiments of the invention is for more detailed explanation in association with the drawings.

DETAILED DESCRIPTION OF THE INVENTION

Figure 1:
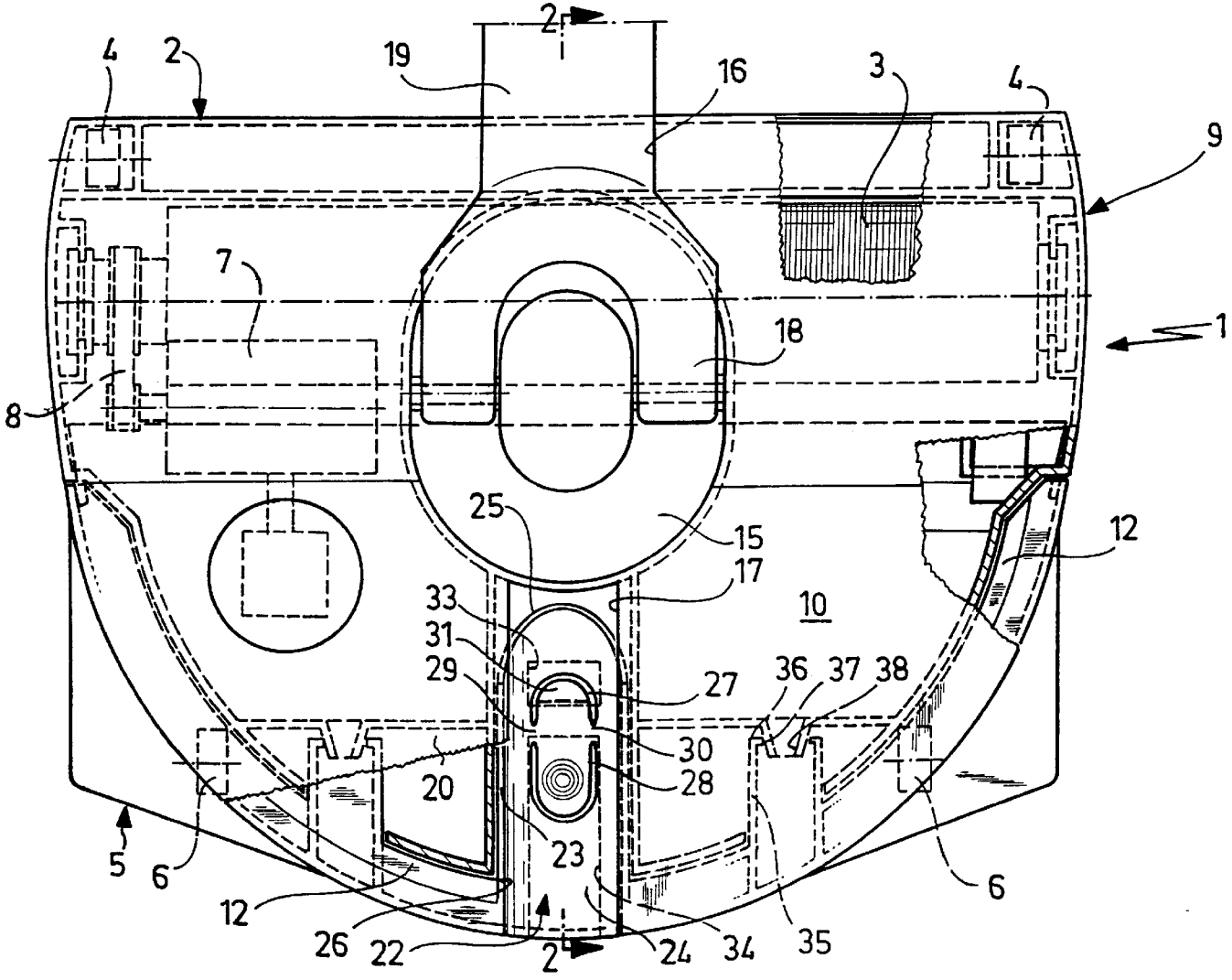
FIG. 1 is a top view onto a sweeping machine with drawer inserted.

The sweeping machine 1 shown in the drawing comprises a housing 2 with a rotary brush 3 rotatably mounted therein and projecting downwards out of the housing 2 and with rollers 4 as well as a dirt container 5, which is connected to the housing 2 and also bears rollers 6, so that the sweeping machine 1 is overall capable of running on a surface to be cleaned transversely to the rotational axis of the rotary brush 3. The rotary brush 3 is set in rotation by a drive means 7 via a belt 8 and said drive means 7 can be a battery-fed electric motor, for example, in other embodiments the drive means 7 could also be a gear, which transfers the rotational movement of the rollers 4 onto the rotary brush 3.

The housing 2 comprises a working part 9, which accommodates the rotary brush 3 and the drive means 7, and an essentially plate-shaped support part 10, which projects parallel to the running plane of the sweeping machine 1 on the upper side of the work part 9 and which completely covers the dirt container 5 directly adjoining the work part 9.

This dirt container 5 is constructed as a drawer and is only open on its front side 11 pointing towards the work part 9. On the upper side, the dirt container 5 has a guide strip 12, which extends in a semicircle, projects radially inwards and engages into a semicircular guide groove 13 on the outer edge of the support part 10 when the dirt container 5 has fully approached the work part 9. As a result of this, the dirt container 5 is held on the support part 10, namely in a position in which the open front side 11 of the drawer-type dirt container 5 lies opposite with a dirt outlet opening 14 on the side of the work part 9 of the housing 2 facing the dirt container 5. As a result, dirt particles picked up from the surface to be cleaned by the rotary brush 3 as a result of its rotational movement can pass through the dirt outlet opening 14 via the open front side 11 and into the interior of the dirt container 5.

On its upper side, the work part 9 of the housing 2 bears a ring-shaped oval depression 15, which merges on both sides into a channel-shaped straight depression 16 or 17 running parallel to the direction of movement of the sweeping machine 1, in which case both depressions 16 and 17 respectively extend as far as the edge of the housing 2. This results in a receiving area for the fork-shaped base 18 of a rod-shaped operating grip 19, which is disposed on the upper side of the housing 2 to swivel around a rotational axis running transversely to the direction of movement in the centre of the oval depression 15, and which can be accommodated at both its end positions in the oval depression 15 and the adjoining depression 16 or the oval depression 15 and the adjoining depression 17. These end positions are principally required when the sweeping machine has to be stowed after the operation has ended, during operation the operating grip 19 is swivelled into a position in which it extends upwards on an incline so that the sweeping machine 1 can be moved along the surface to be cleaned with this operating grip 19.

The depression 17, which extends in the support part 10 of the housing 2, is semicircular in cross-section, the plane upper side 20 of the support part 10 projects slightly into the cross-section of this semicircular depression and with its underside forms a horizontal plane guide surface 21, which laterally closes off the depression 17 on the upper side.

A half shell 22 open at the top is moulded onto the dirt container 5 on its upper side, and extends in the direction of insertion of the dirt container 5, is semicircular in cross-section and its dimensions are selected so that the half shell 22 extends into the channel-shaped depression 17 upon insertion of the dirt container 5 and then abuts with its outer wall against the inner wall of this channel-shaped depression 17.

The upper edge 23 of the half shell 22 has a section 25, which begins and ascends at the free end of the half shell 22 in the region of its base surface 24, and a section 26, which adjoins it and runs parallel to the direction of insertion, said section 26 of the upper edge 23 abutting against the guide face 21 of the depression 17 when the dirt container 5 is inserted. As a result of this, the dirt container is guided and centred during insertion so that the guide strip 12 engages directly into the guide groove 13 when the dirt container 5 is fully inserted, no special adjusting movements by the user are necessary for this, even if the dirt container 5 is brought onto the housing 2 tilted or askew, it is straightened during the insertion movement as a result of the half shell 22 plunging into the channel-shaped depression 17.

In the base surface 24 of the half shell 22 two U-shaped incisions 27, 28 are located which lie opposite one another with their ends and have narrow webs 29, 30 of the base material standing between them. As a result of these incisions 27 and 28 a portion of the base surface 24 is formed which serves as catch element 31. On its underside on its end facing the work part 9 of the housing 2, this catch element bears a catch lug 32, which extends into a catch opening 33 in the channel-shaped depression 17 when the dirt container 5 is fully inserted (FIG. 2) and thus secures the dirt container 5 against being pulled out.

Figure 5:
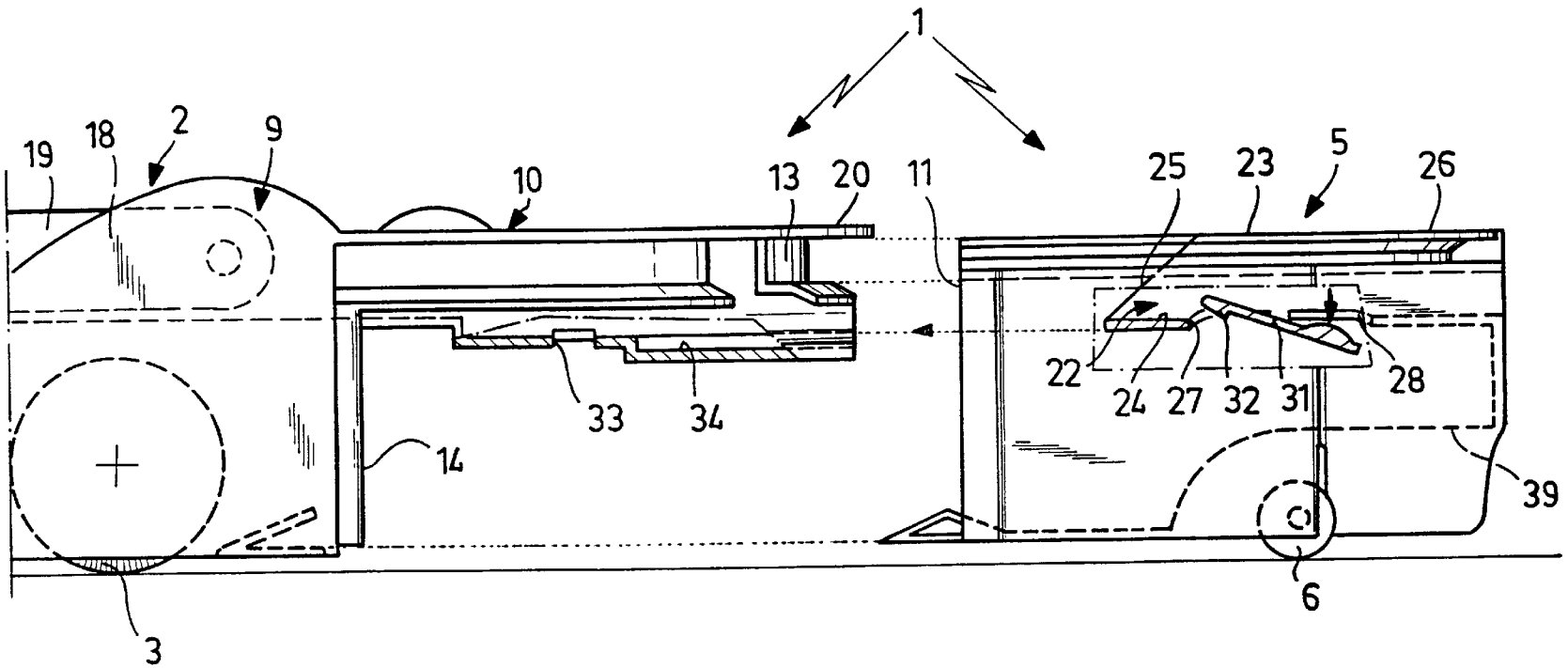
FIG. 5 is a partial side view of the housing with the drawer pulled out.

The webs 29 and 30 are very narrow and form a torsion hinge, around the longitudinal axis of these webs the catch element 31 can be swivelled slightly, as is clear from the illustration in FIG. 5. During this swivelling movement the catch lug 32 is raised out of the catch opening 33 so that the dirt container 5 can be pulled out of the insertion position.

Figure 2:
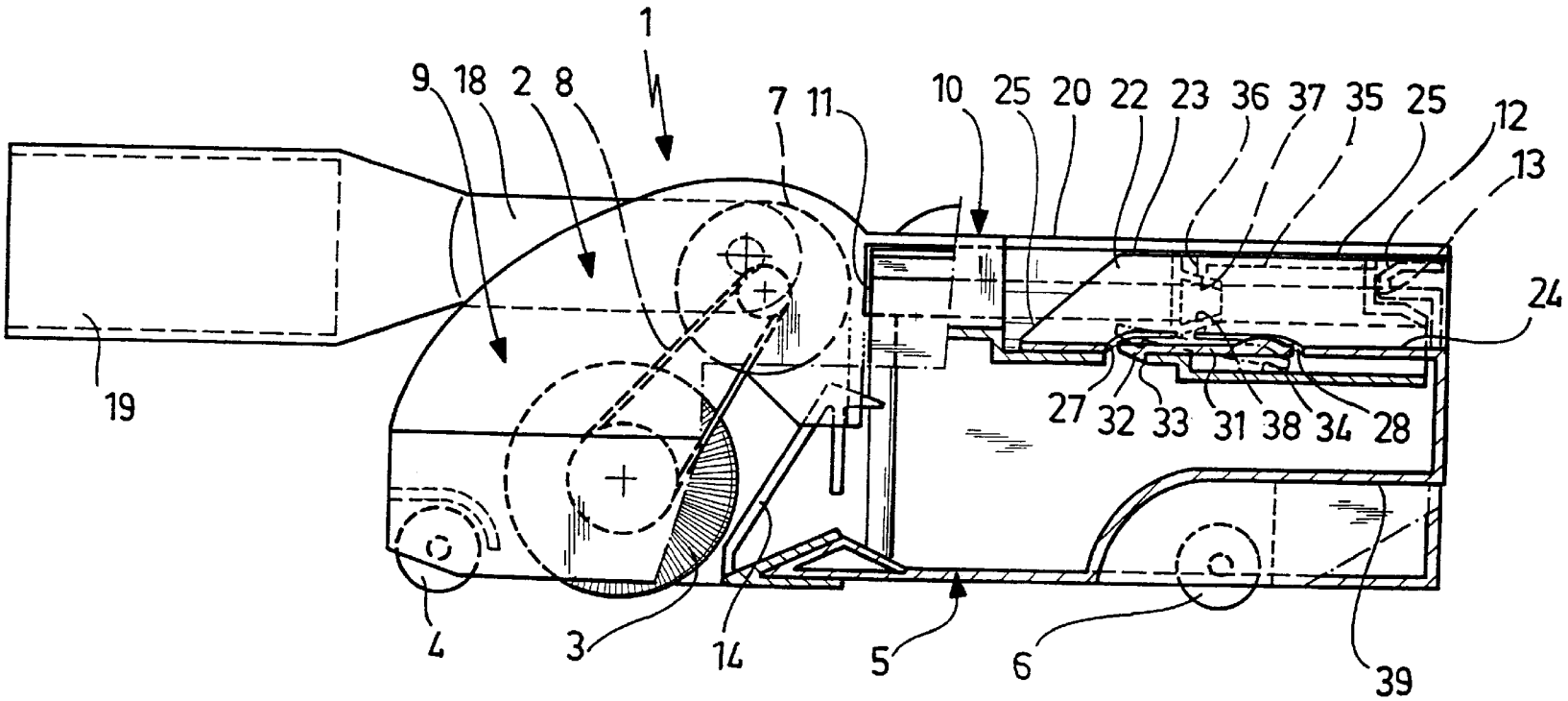
FIG. 2 is a sectional view taken along line 2—2 in FIG. 1.
Figure 3:
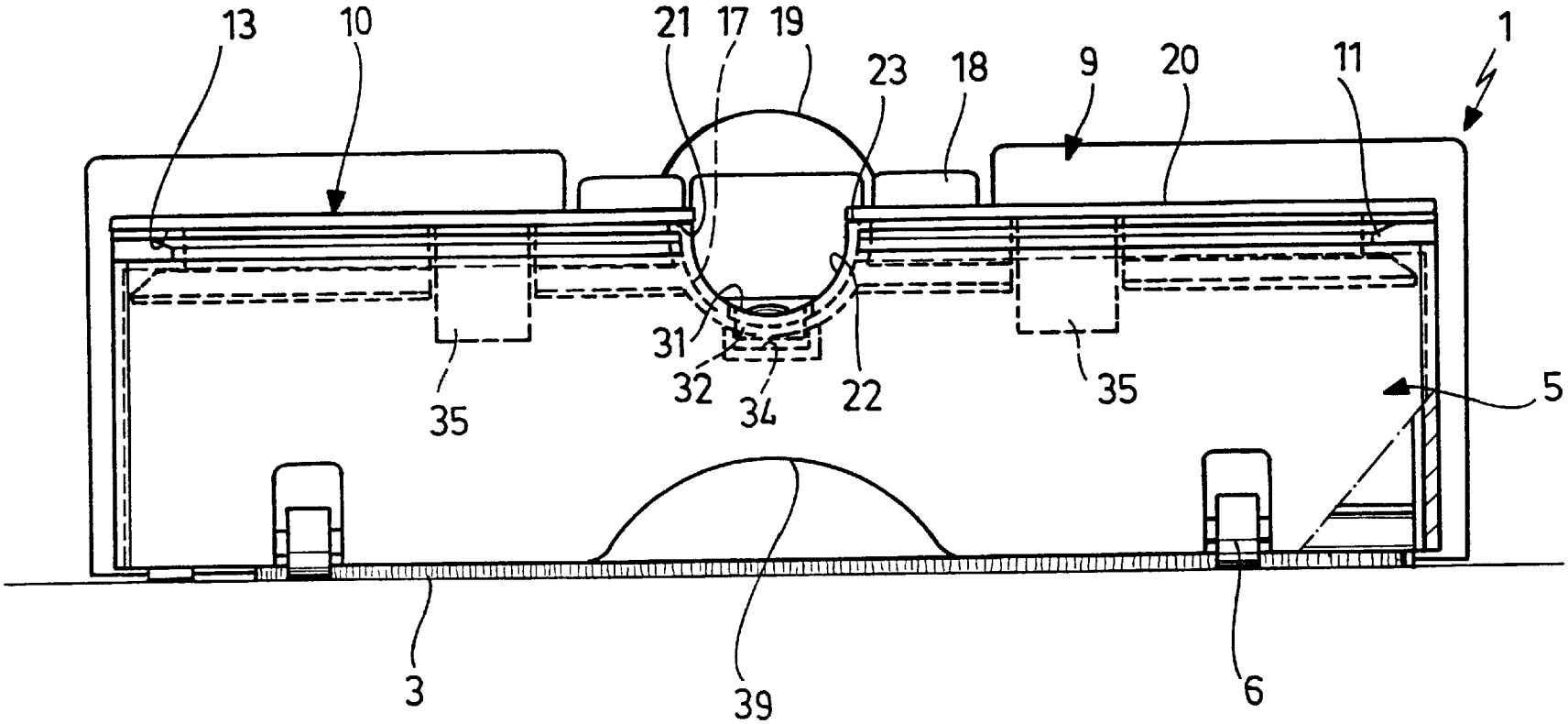
FIG. 3 is a view of the sweeping machine of FIG. 1 viewed from the drawer.

On the base of the depression 17 an elongated depression 34 adjoins the catch opening 33, and said elongated depression receives the lowered portion of the catch element 31 during swivelling of the catch element 31 into its open position and at the same time restricts the swivelling movement of the catch element 31 so as to prevent any damage to the webs 29 and 30 as a result of being swivelled too far. This depression 34 thus forms a stop to restrict the swivelling angle of the catch element 31 (FIG. 2).

Figure 4:
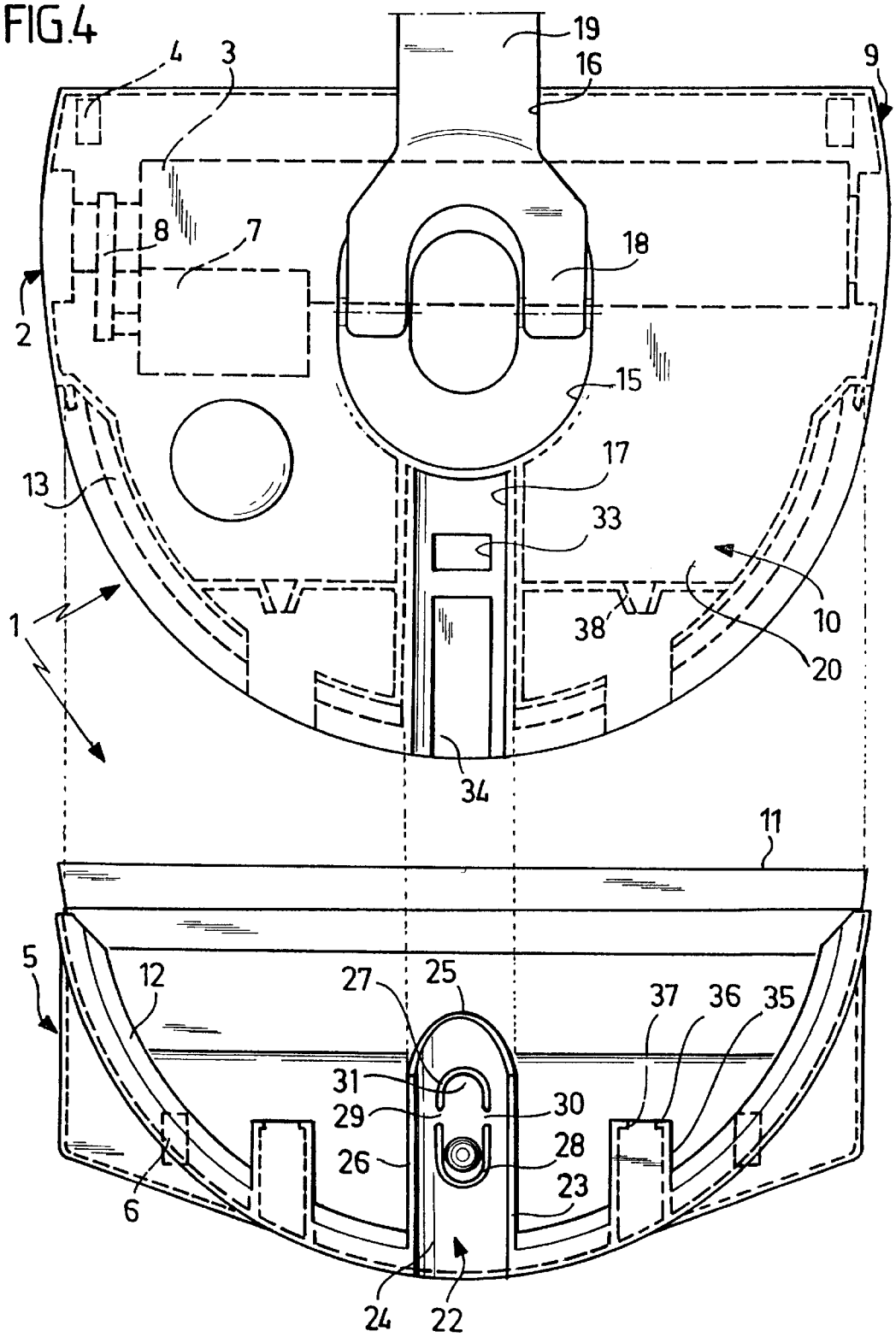
FIG. 4 is a view similar to FIG. 1 with the drawer pulled out of the housing.

On the dirt container 5 on both sides beside the half shell 22, further guide elements 35 are disposed which are constructed as short ducts of square cross-section, extend parallel to the half shell 22 and bear an opening 37 on their front side 36 facing the work part 9 of the housing 2. Wall elements 38 curved on an incline, which are held on the support part 10 of the housing 2 and point towards the dirt container 5, enter this opening 37 when the dirt container 5 is fully inserted (FIGS. 1 and 4).

These wall elements 38 are elastically deformable so that when entering the openings 37 of the guide elements 35, they not only centre these but also exert an elastic force onto these, which is directed in the pull-out direction of the dirt container 5. As a result, the dirt container 5 is placed under prestress upon full insertion and locking of the catch element 31, as soon as the catch element 31 is released, the dirt container 5 is therefore pushed out slightly so that when springing back the catch element can no longer engage behind the catch lug 32, and locking therefore remains released. In addition, the consequence of this is that the dirt container 5 is reliable in operation and is connected to the housing 2 of the sweeping machine 1 in the exactly determined position.

Opposite the channel-shaped depression 17 on the underside of the dirt container 5, a further depression 39 is located which facilitates the engagement of the dirt container 5 jointly with the depression 17. The user can place a finger both in depression 39 and also in depression 34 and thus grasp the part of the dirt container located between these two depressions in the manner of a grip and therefore securely handle the dirt container 5, whether to empty it or to insert it into the housing 2.

The described structural parts of the sweeping machine 1 are simple to produce, they are preferably made of plastic and they are easy to detachably connect to one another so that operation is considerably easier than known sweeping machines of this type. In particular, the dirt container 5 can be connected to the housing 2 by a simple pushing movement and separated from it again by simply pressing on the catch element 31, so that emptying can be achieved by transport of the dirt container 5 only, the sweeping machine itself does not need to be transported to the emptying site.

What is claimed is:

1. A mobile sweeping machine, comprising:

a rotationally driven rotary brush which is mounted in a housing, a dirt collection container which can be detachably connected to the housing, a dirt inlet opening located adjacent to the rotary brush in the dirt collection container, guide elements for guiding insertion of the dirt collection container, said guide elements being formed by strip-type projections on said dirt collection container and a groove in said housing, said strip-type projections adapted to be inserted into the groove, wherein:

the dirt collection container is configured as a drawer, which can be laterally inserted into the housing via the guide elements, said drawer can be fixed in an inserted position relative to the housing, the groove and the strip-type projections are semicircular, and a projection pointing in the direction of the housing is disposed on the drawer, said projection extending into a guide of the housing and thus guiding the drawer during insertion before the strip-type projections enter the groove.

2. A mobile sweeping machine according to claim 1, wherein rollers, which fully support the sweeping machine, are disposed on the housing and on the dirt collection container.

3. A mobile sweeping machine according to claim 1, wherein the groove is disposed on a flat support part of the housing, which, running essentially parallel to a transport surface, extends from a working part of the housing accommodating the rotary brush and drive means for said rotary brush.

4. A mobile sweeping machine according to claim 3, wherein the support part essentially completely covers the drawer on its upper side.

5. A mobile sweeping machine according to claim 1, wherein the projection is formed by a half shell, which extends in the direction of insertion of the drawer and is inserted into a trough-shaped depression on the upper side of the housing.

6. A mobile sweeping machine according to claim 5, wherein the trough-shaped depression has guide faces engaging over the upper edge of the half shell.

7. A mobile sweeping machine according to claim 6, wherein the upper edge of the half shell has a first section rising from the base of the half shell and a second section adjoining said first section and running parallel to the direction of insertion of the drawer.

8. A mobile sweeping machine according to claim 5, wherein the half shell is open on a front side at an end remote from the housing.

9. A mobile sweeping machine according to claim 5, wherein the trough-shaped depression merges into a receiving depression for a gripping element.

10. A mobile sweeping machine according to claim 9, wherein a gripping element is disposed to swivel on the upper side of the housing and in an end position extends into the receiving depression and into the adjoining trough-shaped depression as well as the half shell inserted therein.

11. A mobile sweeping machine according to claim 1, wherein an elastic catch is provided to fix the drawer on the housing.

12. A mobile sweeping machine according to claim 5, wherein:

an elastic catch is provided to fix the drawer on the housing, and the elastic catch is disposed on a base of the half shell and engages behind a recess on the trough-shaped depression.

13. A mobile sweeping machine according to claim 12, wherein the elastic catch is formed by a region of the base of the half shell, which is separated from the rest of the half shell by two U-shaped incisions and only remains connected to the base of the half shell via two deformable webs located between the ends of the opposing incisions.

14. A mobile sweeping machine according to claim 13, wherein at a distance below the half shell the trough-shaped depression forms a stop restricting the swivelling movement of the elastic catch.

15. A mobile sweeping machine according to claim 5, wherein the drawer has a grip depression on its underside opposite the half shell.

16. A mobile sweeping machine, comprising:

a rotationally driven rotary brush which is mounted in a housing, a dirt collection container which can be detachably connected to the housing, a dirt inlet opening located adjacent to the rotary brush in the dirt collection container, and guide elements for guiding insertion of the dirt collection container, said guide elements being formed by strip-type projections on said dirt collection container and a groove in said housing, said strip-type projections adapted to be inserted into the groove, wherein:

the dirt collection container is configured as a drawer, which can be laterally inserted into the housing via the guide elements, said drawer can be fixed in an inserted position relative to the housing, the groove and the strip-type projections are semicircular, and spring elements are disposed between the housing and drawer which act on the drawer in a pull-out direction.

17. A mobile sweeping machine according to claim 16, wherein the spring elements are at the same time intermeshing guide elements.

18. A mobile sweeping machine according to claim 16, wherein rollers, which fully support the sweeping machine, are disposed on the housing and on the dirt collection container.

19. A mobile sweeping machine according to claim 16, wherein the groove is disposed on a flat support part of the housing, which, running essentially parallel to a transport surface, extends from a working part of the housing accommodating the rotary brush and drive means for said rotary brush.

20. A mobile sweeping machine according to claim 19, wherein the support part essentially completely covers the drawer on its upper side.

21. A mobile sweeping machine according to claim 16, wherein an elastic catch is provided to fix the drawer on the housing.

* * * * *